US010603766B2

(12) United States Patent
Wilson et al.

(10) Patent No.: US 10,603,766 B2
(45) Date of Patent: Mar. 31, 2020

(54) ABRASIVE ARTICLE WITH ABRASIVE PARTICLES HAVING RANDOM ROTATIONAL ORIENTATION WITHIN A RANGE

(71) Applicant: 3M INNOVATIVE PROPERTIES COMPANY, St. Paul, MN (US)

(72) Inventors: Geoffrey I. Wilson, Woodbury, MN (US); Brian G. Koethe, Cottage Grove, MN (US); Steven J. Keipert, Houlton, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 161 days.

(21) Appl. No.: 15/735,504

(22) PCT Filed: Jun. 13, 2016

(86) PCT No.: PCT/US2016/037250
§ 371 (c)(1),
(2) Date: Dec. 11, 2017

(87) PCT Pub. No.: WO2016/205133
PCT Pub. Date: Dec. 22, 2016

(65) Prior Publication Data

US 2018/0161960 A1 Jun. 14, 2018

Related U.S. Application Data

(60) Provisional application No. 62/182,069, filed on Jun. 19, 2015.

(51) Int. Cl.
*B24D 11/00* (2006.01)
*B24D 13/14* (2006.01)
(Continued)

(52) U.S. Cl.
CPC ..... *B24D 11/001* (2013.01); *B24B 21/04* (2013.01); *B24D 3/00* (2013.01); *B24D 11/00* (2013.01);
(Continued)

(58) Field of Classification Search
CPC ..... B24D 11/001; B24D 21/04; B24D 3/00; B24D 11/00; B24D 13/14; B24D 2203/00
(Continued)

(56) References Cited

U.S. PATENT DOCUMENTS 4,314,827 A 2/1982 Leitheiser
4,623,364 A 11/1986 Cottringer
(Continued)

FOREIGN PATENT DOCUMENTS

WO WO 2011/068724 6/2011
WO WO 2011/109188 9/2011
(Continued)

OTHER PUBLICATIONS

Supplementary European Search Report for EP 16 81 2207, completed Jan. 15, 2019.
(Continued)

*Primary Examiner* — George B Nguyen
(74) *Attorney, Agent, or Firm* — Aleksander Medved

(57) ABSTRACT

An abrasive article includes a plurality of abrasive particles and the rotational orientation of at least a portion of the abrasive particles about the z-axis varies randomly within a defined range, and the spacing of the abrasive particles along the y-axis varies randomly.

18 Claims, 3 Drawing Sheets

(51) Int. Cl.
*B24D 3/00* (2006.01)
*B24B 21/04* (2006.01)

(52) U.S. Cl.
CPC ..... *B24D 13/14* (2013.01); *B24D 2203/00* (2013.01)

(58) Field of Classification Search
USPC ..... 451/526–539
See application file for complete search history.

(56) References Cited

U.S. PATENT DOCUMENTS

| | | | |
|---|---|---|---|
| 4,652,275 | A | 3/1987 | Bloecher |
| 4,744,802 | A | 5/1988 | Schwabel |
| 4,770,671 | A | 9/1988 | Monroe |
| 4,799,939 | A | 1/1989 | Bloecher |
| 4,848,041 | A | 7/1989 | Kruschke |
| 4,881,951 | A | 11/1989 | Wood |
| 5,152,917 | A | 10/1992 | Pieper |
| 5,201,916 | A | 4/1993 | Berg |
| 5,213,591 | A | 5/1993 | Celikkaya |
| 5,297,364 | A | 3/1994 | Tuttle |
| 5,366,523 | A | 11/1994 | Rowenhorst |
| 5,435,816 | A | 7/1995 | Spurgeon |
| RE35,570 | E | 7/1997 | Rowenhorst |
| 5,672,097 | A | 9/1997 | Hoopman |
| 5,946,991 | A | 9/1999 | Hoopman |
| 5,975,987 | A | 11/1999 | Hoopman |
| 5,984,988 | A | 11/1999 | Berg |
| 6,319,108 | B1 | 11/2001 | Adefris et al. |
| 8,034,137 | B2 | 10/2011 | Erickson |
| 8,142,531 | B2 | 3/2012 | Adefris |
| 8,142,532 | B2 | 3/2012 | Erickson |
| 8,142,891 | B2 | 3/2012 | Culler |
| 2005/0060941 | A1 | 3/2005 | Provow et al. |
| 2007/0037500 | A1 | 2/2007 | Minick |
| 2009/0017276 | A1 | 1/2009 | Hoglund |
| 2009/0165394 | A1 | 7/2009 | Culler |
| 2009/0169816 | A1 | 7/2009 | Erickson |
| 2012/0227333 | A1 | 9/2012 | Adefris |
| 2013/0040537 | A1 | 2/2013 | Schwabel |
| 2013/0125477 | A1 | 5/2013 | Adefris |
| 2013/0344786 | A1* | 12/2013 | Keipert ..... B24D 3/28 451/529 |
| 2014/0106126 | A1 | 4/2014 | Gaeta et al. |
| 2014/0259961 | A1 | 9/2014 | Moren |
| 2014/0290147 | A1* | 10/2014 | Seth ..... B24D 18/0054 51/298 |
| 2015/0000209 | A1* | 1/2015 | Louapre ..... B24D 3/00 51/309 |
| 2016/0014448 | A1 | 5/2016 | Eugster |
| 2016/0311084 | A1* | 10/2016 | Culler ..... B24D 11/001 |

FOREIGN PATENT DOCUMENTS

| | | |
|---|---|---|
| WO | WO 2014/004991 | 1/2014 |
| WO | WO 2015/050781 | 4/2015 |
| WO | WO 2016/160357 | 10/2016 |
| WO | WO 2016/205267 | 12/2016 |
| WO | WO 2017/007703 | 1/2017 |
| WO | WO 2017/007714 | 1/2017 |

OTHER PUBLICATIONS

International Search Report for PCT/US2016/037250, dated Sep. 30, 2016 (4 pages).

* cited by examiner

ABRASIVE ARTICLE WITH ABRASIVE PARTICLES HAVING RANDOM ROTATIONAL ORIENTATION WITHIN A RANGE

CROSS REFERENCE TO RELATED APPLICATIONS

This application is a national stage filing under 35 U.S.C. 371 of PCT/US2016/037250, filed Jun. 13, 2016, which claims the benefit of U.S. Provisional Patent Application No. 62/182,069, filed Jun. 19, 2015, the disclosures of which are incorporated by reference in their entirety herein.

BACKGROUND

The present disclosure relates generally to abrasive articles and, more particularly, to an abrasive article having abrasive particles arranged in a non-random fashion.

Controlling the z-direction rotational orientation of shaped abrasive particles about their longitudinal axis can enhance the performance of abrasive articles. Abrasive articles having oriented abrasive particles are known in the prior art. U.S. Patent Publication No. US2014/0259961 (Moren et al), for example, discloses a method of applying abrasive particles to a backing using an electrostatic force wherein the z-direction rotational orientation of the particles in a coated abrasive article can be varied. U.S. Patent Publication No. US2013/0344786 (Keipert) discloses a coated abrasive article having a plurality of formed ceramic abrasive particles each having a surface feature wherein the surface feature has a specified z-direction rotational orientation, and wherein the specified z-direction rotational orientation occurs more frequently than would occur by a random z-direction rotational orientation of the surface feature. German Patent Publication 10 2013 212 609 discloses a method of producing an abrasive for which the abrasive particles are scattered on at least one abrasive backing characterized in that the abrasive particles are scattered at least partly aligned by at least one alignment aid.

SUMMARY

Known abrasive articles having abrasive particles with a selective z-direction rotational orientation can be difficult and/or expensive to produce, may not possess the desired degree of rotational orientation (i.e. the abrasive particles may possess too much or too little rotational orientation), and may be limited in terms of the type (e.g. size or shape) of abrasive particle that can be utilized in the construction of the abrasive article.

The need exists for an abrasive article that overcomes the shortcomings noted above. Accordingly, it would be desirable to provide an abrasive article, such as a coated abrasive article, having a selective z-direction rotational orientation that is easier and less expensive to produce, has abrasive particles with the desired degree of rotational orientation, and that can be produced using abrasive particles having a wide variety of sizes and shapes. More particularly, it would be desirable to provide an abrasive article having abrasive particles that are oriented in a controlled manner, and the angular orientation of at least a portion of the abrasive particles varies randomly within a defined range.

The present invention provides an abrasive article having a y-axis, an x-axis transverse to the y-axis, and a z-axis orthogonal to the y-axis and x-axis. The abrasive article comprises a plurality of abrasive particles wherein the rotational orientation of at least portion of the abrasive particles about the z-axis varies randomly within a defined range, and the spacing of the abrasive particles varies randomly along the y-axis.

In certain embodiments, the abrasive article may include one or more of the following features: the spacing of the abrasive particles in the x-axis direction may be random; the spacing of the abrasive particles may be more uniform in the x-axis direction than the y-axis direction; the spacing of the abrasive particles in the x-axis direction may vary within a defined range; the abrasive particles may be arranged in rows and the average deviation of the location of an abrasive particle within a row may vary randomly by no more than about plus or minus (+/−) 4 times the thickness of the abrasive particle; at least a portion of the abrasive particles may be arranged in rows having a longitudinal axis, each abrasive particle may have a longitudinal axis, and the longitudinal axis of at least a portion of the abrasive particles may be within a defined range; the longitudinal axis of the row may be parallel to the abrasive article y-axis; the longitudinal axis of the row may be offset at an angle from the abrasive article y-axis; the abrasive particles may be provided in a generally arcuate path and the y-axis may be tangent to the arcuate path; the z-direction rotational orientation of at least about 55 percent of the abrasive particles may be within about +/−45 degrees of the average particle z-direction rotational orientation; at least a portion of the abrasive particles may be elongate and be configured to be oriented in an upright position by passing them through an elongate slot; at least a portion of the abrasive particles may have a length, width, thickness and an elongate edge, and the width and length may be greater than the thickness; at least a portion of the abrasive particles may have a generally plate-like shape; at least a portion of the abrasive particles may comprise crushed abrasive particle having a plate-like shape, shaped abrasive particles having a plate-like shape, and combinations thereof; the abrasive particles may comprise an agglomerate having a plate-like shape; the abrasive article may include a mixture of abrasive particles including a portion having a generally uniform size and shape and a portion having a generally uniform size and a non-uniform shape; about 80-90 percent of the abrasive particles may be inclined at an angle of at least about 45 degrees from the plane defined by the x and y axes; a portion of the abrasive particles may have an average weight of at least about 1 milligram; and/or a portion of the abrasive particles may have an average volume of at least about 5 cubic millimeters.

In another embodiment, the present invention provides a coated abrasive article comprising a backing having opposed first and second major surfaces, a longitudinal axis and a transverse axis; a make coat on at least a portion of one of the first and second major surfaces; and a plurality of abrasive particles secured to the backing via the make coat, wherein each abrasive particle includes a y-direction axis extending in the direction of the longitudinal axis of the backing, and a z-direction axis orthogonal to the longitudinal axis of the backing; wherein the rotational orientation of a majority of the abrasive particles about the z-axis varies randomly within a defined range, and further wherein the spacing of the abrasive particles in the y-direction varies randomly.

In another embodiment, the present invention provides an abrasive disc comprising a backing having opposed first and second major surfaces, an annular path and a z-axis orthogonal to at least one of the first and second major surfaces; a make coat on at least one of the first and second major surfaces; and a plurality of abrasive particles secured to the backing via the make coat, wherein the rotational orientation of a majority of the abrasive particles about the z-axis varies randomly within a defined range, and further wherein the spacing of the abrasive particles along the annular path varies randomly.

In a specific aspect, the abrasive article according to the embodiments described herein may be used to grind metal. In one embodiment, the abrasive article may be in the form of a continuous belt, and the belt may be used to grind metal, such as titanium, by bringing the abrasive belt into contact with the metal.

As used herein, the following terms may have the following meaning:

"Length" refers to the maximum caliper dimension of an object.

"Width" refers to the maximum caliper dimension of an object perpendicular to the length axis.

The term "thickness" refers to the caliper dimension of an object that is perpendicular to the length and width dimensions.

The term "caliper dimension" is defined as the distance between the two parallel planes restricting the object perpendicular to that direction.

The term "platey abrasive particle" and particles described as having a "plate-like shape" refer to an abrasive particle resembling a platelet and/or flake that is characterized by a thickness that is less than the length and width. For example, the thickness may be less than ½, ⅓, ¼, ⅕, ⅙, ⅐, ⅛, ⅑, or even less than 1/10 of the length and/or width.

The term "crushed abrasive particle" refers to an abrasive particle that is formed through a fracturing process such as a mechanical fracturing process. The material fractured to produce the crushed abrasive particle may be in the form of bulk abrasive or an abrasive precursor. It may also be in the form of an extruded rod or other profile or an extruded or otherwise formed sheet of abrasive or abrasive precursor. Mechanical fracturing includes, for example, roll or jaw crushing as well as fracture by explosive comminution.

The term "shaped abrasive particle" refers to a ceramic abrasive particle with at least a portion of the abrasive particle having a predetermined shape that is replicated from a mold cavity used to form a precursor shaped abrasive particle which is sintered to form the shaped abrasive particle. Except in the case of abrasive shards (e.g., as described in U.S. Pat. No. 8,034,137 B2 (Erickson et al.)), the shaped abrasive particle will generally have a predetermined geometric shape that substantially replicates the mold cavity that was used to form the shaped abrasive particle. The term "shaped abrasive particle" as used herein excludes abrasive particles obtained by a mechanical crushing operation.

Advantages of certain embodiments described herein include that it provides an abrasive article, such as a coated abrasive article, having a selective z-direction rotational orientation that is easier and less expensive to produce, has abrasive particles with a desired degree of rotational orientation, it can be produced using abrasive particles having a wide variety of sizes and shapes, and it produces a surprisingly uniform surface finish. More specifically, the present invention provides an abrasive article having abrasive particles that are oriented in a controlled manner, and the angular orientation of at least a portion of the abrasive particles varies randomly within a defined range, thereby producing an abrasive article that has a surprisingly high cut rate and produces a smooth surface finish.

DETAILED DESCRIPTION

Figure 1A:
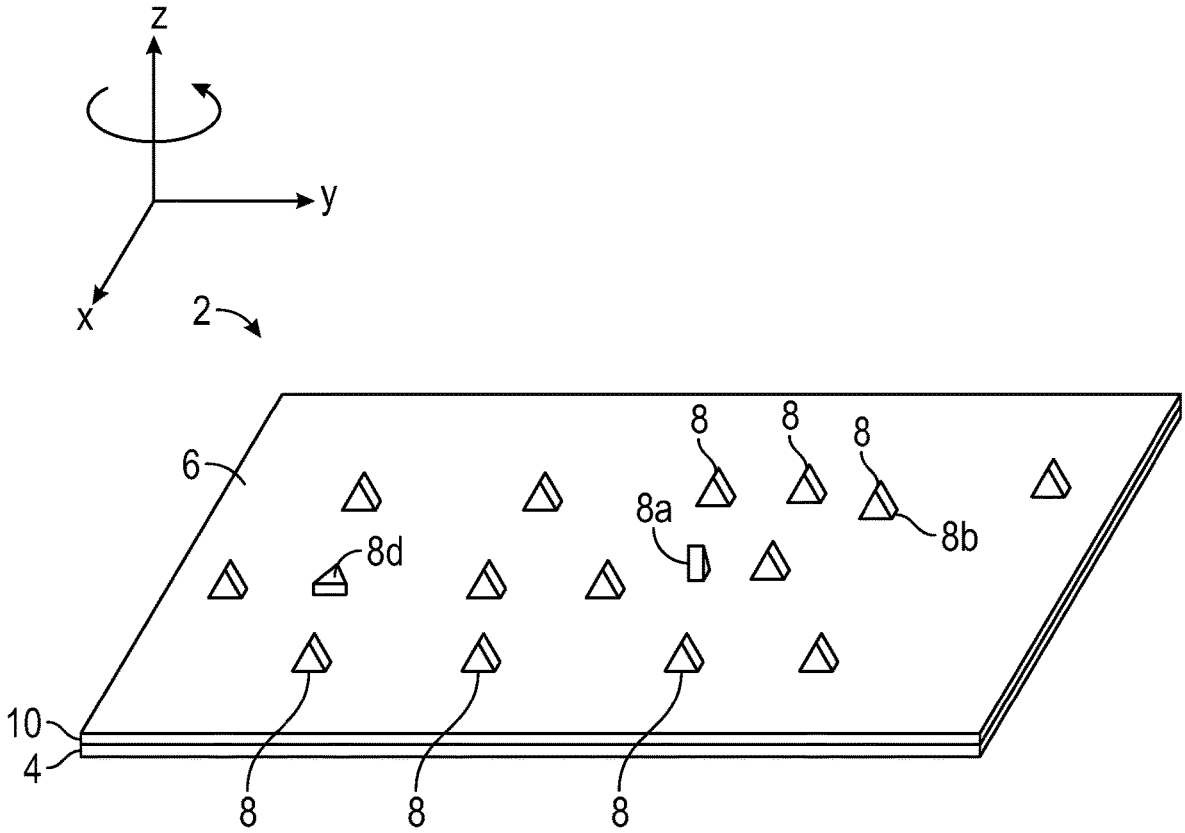
FIG. 1*a* is a perspective view of an abrasive article according to one embodiment of the invention.

Referring now to the drawings, FIG. 1*a* shows an abrasive article 2 comprising a backing or substrate 4 having a first major surface 6, and a plurality of abrasive particles 8 arranged on the first major surface 6 of the substrate 4. Throughout the description and the accompanying figures, functionally similar features are referred to with like reference numerals incremented by 100.

The abrasive particles 8 may be bonded to the backing 4 using, for example, an optional adhesive make coat 10, or the abrasive particles 8 may be affixed directly to the backing 4. In the illustrated embodiment, the abrasive article 2 is a coated abrasive product comprising a flexible backing layer 4 with abrasive particles 8 bonded to the first major surface 6 of the backing layer 4 via the make coat layer 10. In addition, the abrasive article 2 may include an optional size coat (not shown) applied over the abrasive particles 8.

The make coat or size coat 10 is not critical to the invention hereof, so long as it provides the desired function and properties for the particular abrasive article and intended end use application. Suitable make and size coats include a wide variety of known resins including, for example, thermosetting resins such as phenolic resins, aminoplast resins, curable acrylic resins, cyanate resins, urethanes and combinations thereof.

Similarly, the particular backing or substrate 4 is not critical to the invention hereof, so long as it provides the desired function and properties for the particular abrasive article and intended end use application. Suitable backing materials include, for example, cloth, paper, polymeric films, nonwoven materials, vulcanized fiber materials, scrims and other web-like substrates.

In the illustrated embodiment, the abrasive article 2 comprises a single abrasive layer formed by the backing layer 4, make coat 10, and abrasive particles 8. The single abrasive layer may be converted into, for example, abrasive sheets, pads or discs. Alternatively, the abrasive article 2 may comprise a plurality of abrasive layers. In a specific embodiment, the abrasive article 2 may comprise a nonwoven abrasive sheet that is spirally wound onto itself, thereby forming a convolute abrasive disc. Alternatively, the abrasive article may comprise a plurality of nonwoven abrasive sheet layers that are formed into abrasive "flaps" that are arranged radially around a hub to form a flap disc.

For reference purposes, an xyz coordinate system is provided in FIG. 1. In the illustrated embodiment, the abrasive article 2 includes a y-axis corresponding to a longitudinal direction of the abrasive article 2, an x-axis corresponding to a transverse or lateral direction of the abrasive article 2 which is perpendicular to the y-axis, and a z-axis orthogonal to the y-axis and x-axis. The x-axis and y-axis define a plane that generally corresponds to the first major surface 6 of the abrasive article 2, and the z-axis extends outwardly from the x-y plane in the direction away from the first major surface 6 of the abrasive article 2.

In the illustrated embodiment, the abrasive article 2 comprises a backing 4 having a longitudinal axis y, a transverse axis x, and a make coat 10 on at of the first major surface 6 for securing the plurality of abrasive particles 8 to the backing 4. A portion of the abrasive particles 8 include a longitudinal axis extending in the direction of the y-axis of the backing 4, and a z-direction axis orthogonal to the y-axis of the backing 4. In accordance with one aspect of the invention, the z-axis rotational orientation of a majority of the abrasive particles 8 varies randomly within a defined range, and the spacing of the abrasive particles 8 in the y-direction varies randomly.

Figure 1B:
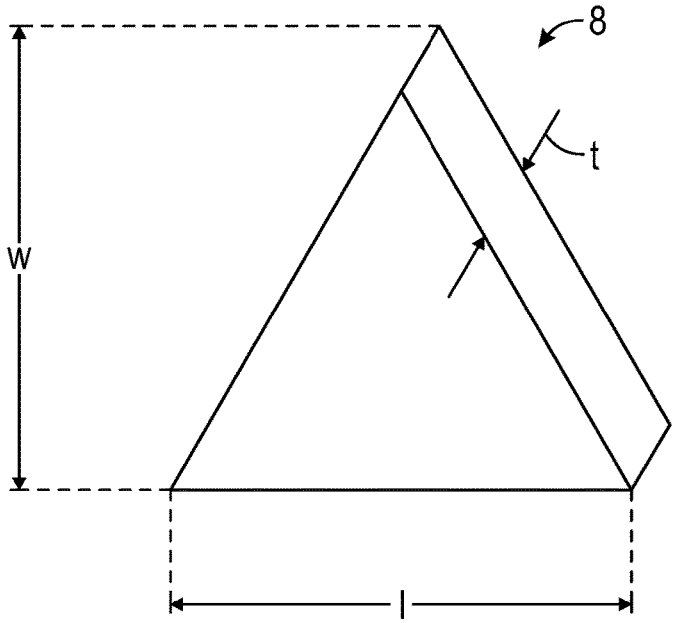
FIG. 1*b* is an enlarged view of an abrasive particle having a triangular profile.

Referring to FIG. 1*b*, there is shown an abrasive particle 8 in detail. The abrasive particle 8 has a generally triangular profile, and possesses a width "w", a length "l" and a thickness "t". In addition, the width w and length l dimensions of the abrasive particle 8 are greater than the thickness t dimension. It will be recognized, however, that a wide variety of abrasive particles may be utilized in the various embodiments described herein. For example, the abrasive particles 8 may be provided in a variety of shapes and profiles, including, for example, regular (e.g. symmetric) profiles such as square, star-shaped or hexagonal profiles, and irregular (e.g. asymmetric) profiles.

The particular type of abrasive particle 8 (e.g. size, shape, chemical composition) is not considered to be particularly significant to the abrasive article 2, so long as at least a portion of the abrasive particles 8 are capable of exhibiting and/or achieving the desired degree of rotational orientation. Thus, the abrasive particle may have a generally symmetric profile, include at least one point, and be capable of exhibiting rotational orientation. In one embodiment, at least a portion of the abrasive particles 8 are elongate and are configured to be oriented in an upright position by passing them through an elongate slot.

Additionally, the abrasive article 2 may include a mixture of abrasive particles that are both capable of exhibiting the desired degree of rotational orientation together with abrasive particles that are not capable of exhibiting the desired degree of rotational orientation.

In some embodiments, suitable abrasive particles will possess an elongate edge and will be capable of being positioned upright on the elongate edge. More specifically, suitable abrasive particles may possess a length and thickness that define an elongate edge, or a width and thickness that define an elongate edge, and the length and width are each greater than the thickness. Configured as such, suitable abrasive particles may be described as having a plate-like shape, or as "platey abrasive particles." Suitable platey abrasive particles include both crushed abrasive particles and shaped abrasive particles. Suitable abrasive particles also include abrasive agglomerates having plate-like shapes.

In another embodiment, the abrasive particles may include a surface feature. Surface features may include, for example, a substantially planer face, a substantially planar surface having a triangular, rectangular, hexagonal, or polygonal perimeter, a concave surface, a convex surface, a vertex, an aperture, a ridge or raised line or plurality of lines, and/or a groove or channel or plurality of grooves or channels. Such surface features may be formed during the molding, extrusion, screen printing or other process that shapes the abrasive particles. In a specific embodiment, such abrasive particles are arranged such that the z-direction rotational orientation of at least a portion of the abrasive particles varies randomly within a defined range.

In yet another embodiment, at least a portion of the abrasive particles include a base, and the abrasive particle is configured to rest on the base in an upright position so as to project outwardly from the substrate.

As alluded to above, the abrasive article 2 may include a mixture of different types of abrasive particles. For example, the abrasive article 2 may include mixtures of platey and non-platey particles, crushed and shaped particles (which may be discrete abrasive particles that do not contain a binder or agglomerate abrasive particles that contain a binder), conventional non-shaped and non-platey abrasive particles (e.g. filler material) and abrasive particles of different sizes, so long as at least a portion of the abrasive particles have a plate-like shape or are otherwise capable of exhibiting the desired degree of rotational orientation.

Examples of suitable shaped abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina crushed abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them). Details concerning such shaped abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Examples of suitable crushed abrasive particles include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minn., brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Further examples include crushed abrasive composites of abrasive particles (which may be platey or not) in a binder matrix, such as those described in U.S. Pat. No. 5,152,917 (Pieper et al.). Many such abrasive particles, agglomerates, and composites are known in the art.

Examples of sol-gel-derived abrasive particles from which crushed abrasive particles can be isolated, and methods for their preparation can be found in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the crushed abrasive particles could comprise abrasive agglomerates such as, for example, those described in U.S. Pat. No. 4,652,275 (Bloecher et al.) or U.S. Pat. No. 4,799,939 (Bloecher et al.). The crushed abrasive particles comprise ceramic crushed abrasive particles such as, for example, sol-gel-derived polycrystalline alpha alumina particles. Ceramic crushed abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

Examples of suitable platey crushed abrasive particles can be found in, for example, PCT Application Number PCT/US2016/022884 and U.S. Pat. No. 4,848,041 (Kruschke), the entire contents of which are hereby incorporated by reference.

The abrasive particles may be surface-treated with a coupling agent (e.g., an organosilane coupling agent) or other physical treatment (e.g., iron oxide or titanium oxide) to enhance adhesion of the crushed abrasive particles to the binder.

Figure 2:
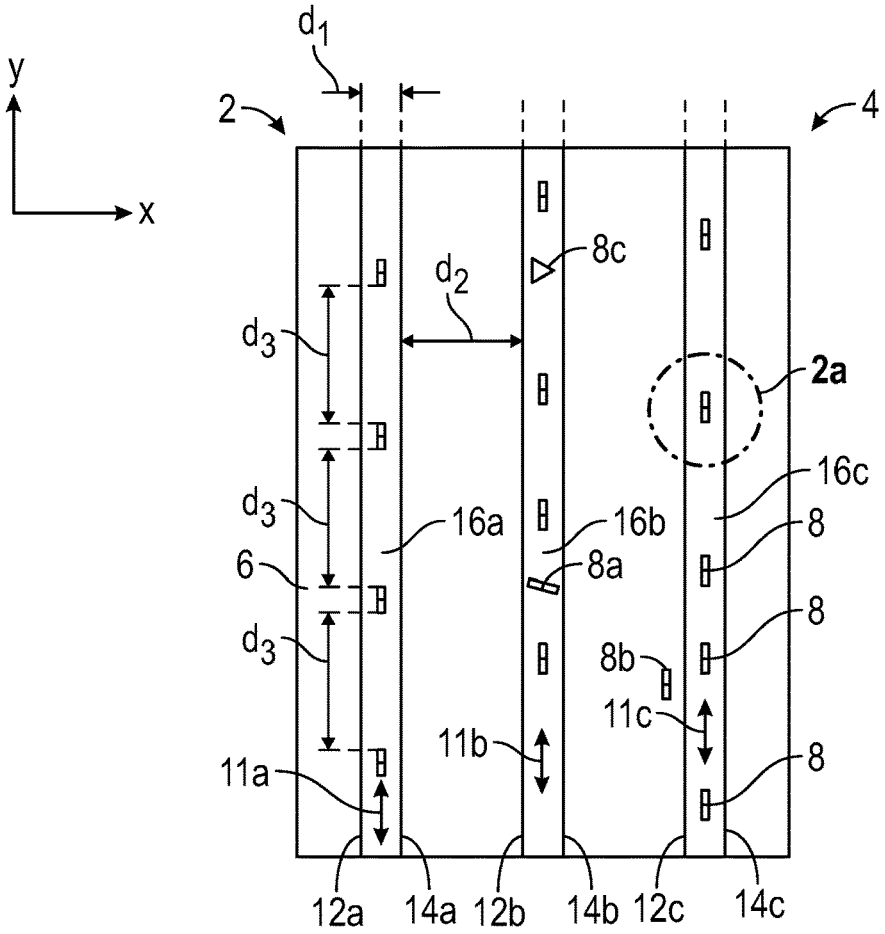
FIG. 2 is a top view of the abrasive article similar to the abrasive article shown in FIG. 1*a*.

Referring to FIGS. 1*a* and 2, the rotational orientation of at least a portion of the abrasive particles 8 about the z-axis varies randomly within a defined range. That is, the degree of z-direction rotational orientation of at least a portion of the abrasive particles 8 is constrained within a defined range, but within the defined range, the z-direction rotational orientation of the abrasive particles varies randomly. It will be recognized, however, that the abrasive article 2 may include a certain percentage of abrasive particles having a z-direction rotational orientation outside of the defined range without deviating from the scope or spirit of the invention described herein. For example, in the abrasive article 2 illustrated in FIGS. 1*a* and 2, abrasive particle labeled 8*a* is intended to represent an abrasive particle having a z-direction rotational orientation that is outside the defined range.

In another aspect, the abrasive particles 8 have an average z-axis rotational orientation, and a defined percentage of abrasive particles has a z-axis rotational orientation within a defined range of the average z-axis rotational orientation. In yet another aspect, the abrasive particles 8 are generally arranged along a path 11*a*, 11*b*, 11*c* having an axis, and each abrasive particle 8 has a longitudinal axis, and the longitudinal axis of at least a portion of the abrasive particles is within a defined range relative to the axis of the paths 11*a*, 11*b* 11*c*. In the embodiment illustrated in FIGS. 1*a* and 2, the path 11*a*, 11*b*, 11*c* of abrasive particles is generally linear. As such, the axis of each path 11*a*, 11*b*, 11*c* of abrasive particles generally corresponds to the longitudinal direction of the path. In addition, in the illustrated embodiment, the axis of each path 11*a*, 11*b*, 11*c* of abrasive particles is generally aligned with the longitudinal axis of the abrasive article, which corresponds to the y-axis. It will be recognized, however, that the axis of each path 11*a*, 11*b*, 11*c* can be offset from the longitudinal axis (i.e. y-axis) of the abrasive article 2. That is, the abrasive particles 8 can be applied to the backing 4 so as to form paths 11*a*, 11*b*, 11*c* that are diagonal to the longitudinal axis of the backing 4. In addition, as explained in more detail below in reference to FIG. 3, if the path of abrasive particles is curved or arcuate, the axis of the path will be tangent to the path at the location of the abrasive particle.

In specific embodiments, the z-direction rotational orientation of at least about 55, 60, 70, 80 or 90 percent of the abrasive particles 8 is within about +/−45 degrees of the average abrasive particle z-direction rotational orientation, at least about 40, 45, 50 or 55 percent, and no greater than about 65, 70, 75 or 80 percent of the z-direction rotational orientation of the abrasive particles is within about +/−30 degrees of the average particle z-direction rotational orientation, at least about 30, 35, 40 or 45 percent and no greater than about 55, 60, 65 or 70 percent of the z-direction rotational orientation of the abrasive particles is within about +/−20 degrees of the average particle z-direction rotational orientation, at least about 15, 20 or 25 percent and no greater than about 30, 35 or 40 percent of the z-direction rotational orientation of the abrasive particles is within about +/−10 degrees of the average particle z-direction rotational orientation, and/or at least about 10 or 15 percent and no greater than about 20 or 25 percent of the z-direction rotational orientation of the abrasive particles is within about +/−5 degrees of the average particle z-direction rotational orientation.

Figure 2A:
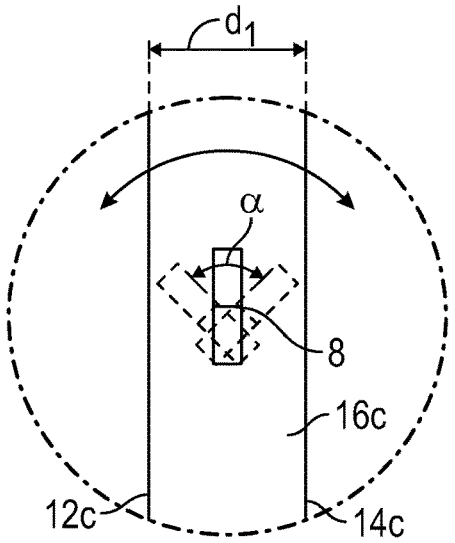
FIG. 2*a* is an enlarged view showing the rotational orientation of an abrasive particle.

Referring now to FIGS. 2 and 2*a*, the defined range of the rotational orientation of at least a portion of the abrasive particles 8 is constrained by a pair of imaginary boundaries 12*a*, 14*a*, 12*b*, 14*b*, 12*c*, 14*c*. The distance between the imaginary boundaries 12*a*, 14*a*, 12*b*, 14*b*, 12*c*, 14*c* is designated d1. The imaginary boundaries 12*a*, 14*a*, 12*b*, 14*b*, 12*c*, 14*c* define regions 16*a*, 16*b*, 16*c*, respectively, that generally constrain the z-direction rotational orientation of the abrasive particles 8 to an angle of less than the angle $\alpha$ (FIG. 2*a*). The degree of rotational orientation is determined in part by the size of the abrasive particle 8 (e.g. by the length 1 and the thickness t) and by the distance d1 between the pair of imaginary boundaries 12*a*, 14*a*, 12*b*, 14*b*, 12*c*, 14*c*.

It will be recognized that the imaginary boundaries 12*a*, 14*a*, 12*b*, 14*b*, 12*c*, 14*c* need not be linear or parallel. That is, the imaginary boundaries 12*a*, 14*a*, 12*b*, 14*b*, 12*c*, 14*c* may be, for example, arcuate, curved, serpentine or irregular, as long as the abrasive particles within the boundaries 12*a*, 14*a*, 12*b*, 14*b*, 12*c*, 14*c* possess the desired degree of z-direction rotational orientation. Because the imaginary boundaries 12*a*, 14*a*, 12*b*, 14*b*, 12*c*, 14*c* generally define a path 11*a*, 11*b*, 11*c* where the abrasive particles can be located, the abrasive particles 8 may be provided in a variety of patterns including, for example, wavy, sinusoidal, circular or in a random path. As described in more detail below, in the case of a wavy, sinusoidal, or circular path, the y-axis of the paths 11*a*, 11*b*, 11*c* is a tangent to the path at the location of the abrasive particle.

In accordance with another aspect of the invention, the location of at least a portion of the abrasive particles is constrained by the distance d1 within the regions 16*a*, 16*b*, 16*c*. In addition, the spacing d2 between adjacent regions 16*a*, 16*b*, 16*c* may be controlled. Thus, with reference to the embodiment illustrated in FIGS. 1*a* and 2, the transverse position of at least a portion of the abrasive particles 8 is constrained within a range defined by the spacing distance d1 within a pair of imaginary boundaries, but within the range defined by d1, the transverse position of the abrasive particles 8 varies randomly. As such, at least a portion of the abrasive particles 8 may be thought of as being arranged in rows and the average deviation of the location of an abrasive particle from the center of the row varies randomly within a defined range such as, for example, at least about 0.5, 1 or 1.5 times the thickness of the abrasive particle to no more than about +/−3, 4 or 5 times the thickness of the abrasive particle 8.

Further, the x-axis spacing distance between adjacent regions 16*a*, 16*b*, 16*c* (d2) is not random. As a result, in certain embodiments, the spacing of the abrasive particles 8 in the x-axis direction is not random. That is, the average x-axis spacing distance between the abrasive particles 8 may vary randomly within a defined range. It will be recognized, however, that even when the abrasive particles 8 are generally arranged in discrete regions, the abrasive article 2 may also include abrasive particles that are outside the regions (i.e. outside the imaginary boundaries). For example, in the abrasive article 2 illustrated in FIGS. 1*a* and 2, abrasive particle 8*b* is shown as lying outside the regions 16*a*, 16*b*, 16*c* defined by the imaginary boundaries 12*a*, 14*a*, 12*b*, 14*b*, 12*c*, 14*c*. Nevertheless, the z-direction rotational orientation of such an abrasive particle may be within the defined range of z-direction rotational orientation for the abrasive article 2.

In a specific embodiment, at least 90 percent of the abrasive particles in a defined region are spaced from the abrasive particles in an adjacent defined region by a distance of at least about 0.01, 0.5, 1, or 2 millimeters and by a distance of no greater than about 5, 7, or 10 millimeters. In another specific embodiment, at least 90 percent of the abrasive particles in a defined region are spaced by a distance of at least about the average thickness of the abrasive particles in an adjacent defined region, and by a distance of no greater than about 5, 7 or 10 times the average thickness of the abrasive particles.

It will be recognized, that as the spacing distance d2 between adjacent regions 16*a*, 16*b*, 16*c* is reduced, the x-axis spacing distance d1 of the abrasive particles 8 within a region will appear random because the location of the abrasive particles 8 within the regions 16*a*, 16*b*, 16*c* also varies in the x-axis direction. That is, when adjacent regions are sufficiently close together (e.g. as the distance d2 is decreases), the x-axis spacing distance d1 of the abrasive particles 8 within the regions will eventually be greater than the x-axis spacing d2 between adjacent region. When this happens (i.e. when the x-axis spacing distance d2 between adjacent regions is less than or equal to the x-axis spacing d1 within the regions), the spacing of the abrasive particles 8 in the x-axis direction appears random. Stated another way, when the variation in the x-axis position of the abrasive particles 8 within a region is greater than the spacing distance d2 between adjacent regions, the regularity of the x-axis spacing d2 between abrasive particles in adjacent region becomes undetectable.

Thus, depending on the x-axis spacing distance d2 between adjacent region, the x-axis spacing distance between abrasive particles may appear either random or appear to vary within a selected range. That is, if the x-axis spacing distance d2 between adjacent regions is sufficiently large compared to d1, the x-axis spacing distance between abrasive particles will appear to vary randomly within a defined range, and if the x-axis spacing distance d2 between adjacent imaginary boundaries is sufficiently small compared to d1, the x-axis spacing distance between abrasive particles will appear random.

In accordance with another aspect of the invention, the distance d3 between adjacent abrasive particles 8 varies randomly along the y-axis. That is, the y-axis distance between adjacent abrasive particles 8 is not fixed, and there is no discernable pattern to the arrangement of the abrasive particles 8 in the y-axis direction. In certain embodiments, however, namely, those in which the x-axis spacing distance between abrasive particles appears to vary randomly within a defined range, the abrasive particles are spaced more uniformly in the x-axis direction than the y-axis direction.

It is desirable for a majority of the abrasive particles 8 to be arranged at an incline relative to the first major surface 6 of the substrate 4. That is, at least a portion of the abrasive particles 8 may be upright and project generally perpendicularly outwardly from the substrate 4. The abrasive article 2 may also include abrasive particles 8 that are not inclined relative to the substrate 4 (i.e. the abrasive particles 8 may lie flat on the substrate 4), and/or include abrasive particles 8 that are inclined at relatively small angles (e.g. less than 45 degrees) relative to the substrate 4. For example, in the abrasive article 2 illustrated in FIGS. 1*a* and 2, abrasive particle 8*c* is shown lying flat on its side.

In specific embodiments, at least about 60, 70 or 80 percent of the abrasive particles are inclined at an angle of at least about 45 degrees from the plane defined by the x and y axes. In other embodiments, up to about 5, 10 or 15 percent of the abrasive particles are inclined at an angle of no greater than about 45 degrees from the plane defined by the x and y axes.

In addition, a certain portion of the abrasive particles 8 may be positioned such that a point of the triangle, rather than an elongate edge, is affixed to the backing 4 (i.e. the triangular abrasive particle appears upside down). The percentage of abrasive particles arranged with a point affixed to the backing 4 rather than an elongate edge, will typically be less than about 2, 3, 4 or 5 percent.

Figure 3:
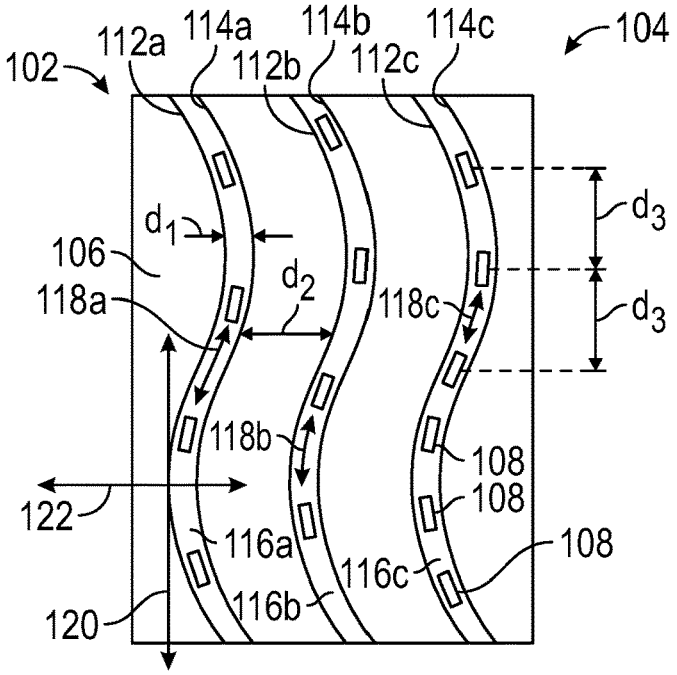
FIG. 3 is a top view of an abrasive article according to a second embodiment of the invention.

Referring now to FIG. 3, there is shown an abrasive article 102 in which imaginary boundaries 112*a*, 114*a*, 112*b*, 114*b*, 112*c*, 114*c* define non-linear paths 118*a*, 118*b*, 118*c*, respectively. The abrasive article 102 comprises a backing 104 having a first major surface 106, and the imaginary boundaries 112*a*, 114*a*, 112*b*, 114*b*, 112*c*, 114*c* define serpentine, wavy or sinusoidal regions 116*a*, 116*b*, 116*c* where a plurality of abrasive particles 108 are secured to the backing 104 via an optional make coat (not shown). In the illustrated embodiment, each abrasive particle 108 includes a first axis 120 tangent to the paths 118*a*, 118*b*, 118*c* (i.e. the "tangent axis") at the location of the abrasive particles 108. The abrasive article 102 further includes a transverse axis 122 orthogonal to the tangent axis 120, and a z-axis orthogonal to the tangent axis 120 and the transverse axis 122 (the z-axis is not shown because it extends directly outwardly from the plane of the page). Thus, in accordance with certain characterizing features of the invention, the rotational orientation of a majority of the abrasive particles 108 about the z-axis varies randomly within a defined range, the spacing distance d3 of the abrasive particles 108 along the paths 118*a*, 118*b*, 118*c* varies randomly, and the transverse spacing distance d2 between the regions 116*a*, 116*b*, 116*c* can be controlled.

Creating a non-linear path of abrasive particles 108 may be accomplished, for example, by varying either the path or orientation of the backing 104 relative to a fixed stream of abrasive particles as the abrasive particles 108 are applied to the backing 104, or moving the stream of abrasive particles 108 relative to a fixed backing 104 as the abrasive particles 108 are applied to the backing 104. Thus, the wavy pattern depicted in FIG. 3 may be created by, for example, oscillating the backing 104 relative to the stream of abrasive particles. The backing 104 may also be vibrated to randomize the placement of the abrasive particles 108 on the backing 104.

Figure 4:
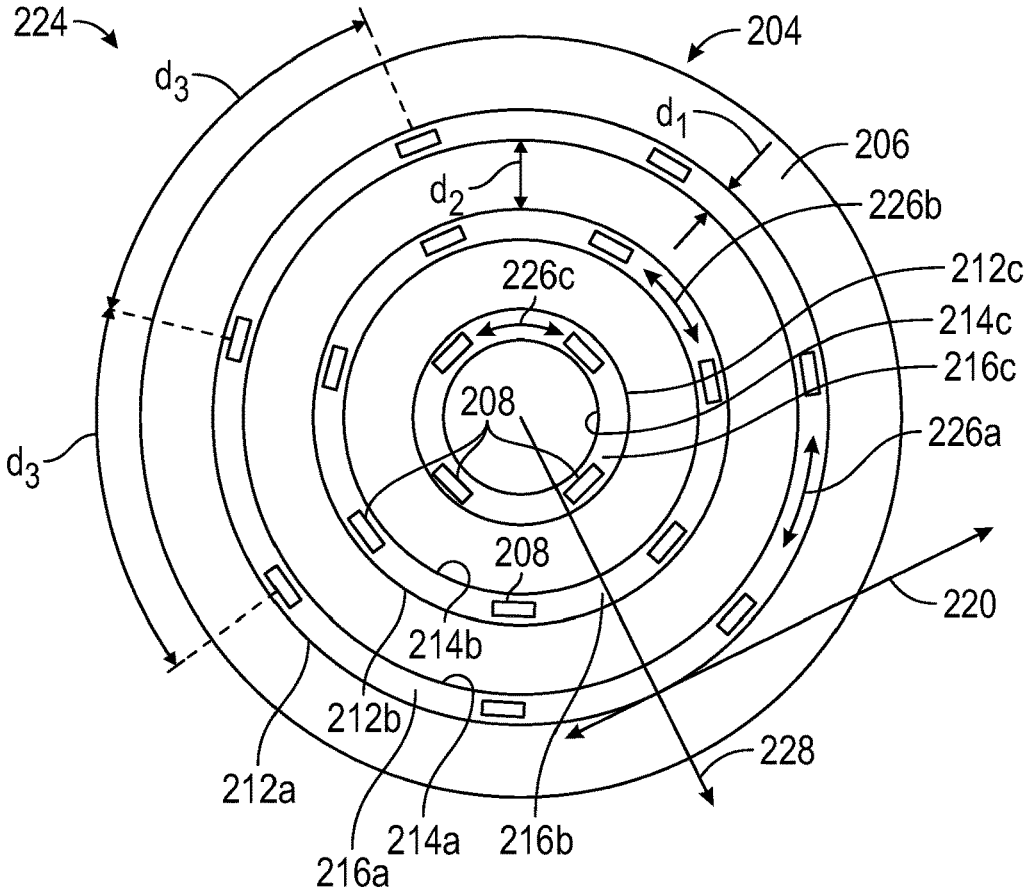
FIG. 4 is a top view of an abrasive article according to a third embodiment of the invention.

Referring to FIG. 4, there is shown an abrasive article in the form of a circular disc 224. The abrasive disc 224 comprises a backing 204 having a first major surface 206, and a plurality of abrasive particles 208 are secured to the backing 204 via an optional make coat (not shown). Imaginary boundaries 212*a*, 214*a*, 212*b*, 214*b*, 212*c*, 214*c* define annular paths 226*a*, 226*b*, 226*c* and further define annular regions 216*a*, 216*b*, 216*c* that generally constrain the location and rotational orientation of the abrasive particle 208. In the illustrated embodiment, the abrasive disc 224 includes a first axis 220 tangent to the annular paths 226 at the location of the abrasive particles 208. The abrasive disc 224 further includes a radial axis 228 orthogonal to the tangent axis 220, and a z-axis orthogonal to the tangent axis 220 and the radial axis 228 (the z-axis is not shown because it extends directly outwardly from the plane of the page). Thus, in accordance with certain characterizing features of the invention, the rotational orientation of a majority of the abrasive particles 208 about the z-axis varies randomly within a defined range, the annular spacing distance d3 of the abrasive particles 208 along the paths 226*a*, 226*b*, 226*c* varies randomly, and the radial spacing distance d2 between the regions 216*a*, 216*b*, 216*c* can be controlled.

Thus, in any of the embodiments described herein, the z-direction rotational orientation of abrasive particles varies within a defined range, and the spacing distance of the abrasive particles along a first major axis of an abrasive path varies randomly. In addition, the spacing distance of the abrasive particles along a second major axis orthogonal to the first major axis may vary randomly within a range or they may appear to vary randomly.

The abrasive articles 2 according to the various embodiments described herein may be formed by passing the abrasive particles 8 through an alignment device, whereby the abrasive particles 8 emerge from and impinge upon the substrate 4 with the desired degree of z-direction rotational orientation and/or placement. In addition, an external force (e.g. gravity, electrostatic, centripetal) may be provided after the abrasive particles pass through the alignment device to assist in maintaining the abrasive particles in their upright position.

The alignment device may comprise, for example, a plurality of elongate slots or openings formed by, for example, a plurality of wires or strings, a comb-like structure, or a plurality of walls that define elongate slots. The size and shape of the elongate slots may vary depending on the size and shape of the abrasive particles being applied to the substrate, and on the desired pattern of the abrasive particles to be applied to the substrate. The elongate slots may be, for example, straight, curved, or arcuate.

The abrasive particles may be applied to or passed through the alignment device using, for example, forced air, by electrostatically propelling them, by dropping them on, for example, a rotating drum, or by gravity feeding them onto or through the alignment device. Techniques useful for applying abrasive particles to the substrate are described in (U.S. Ser. No. 62/189,980), (U.S. Ser. No. 62/182,077) and (62/190,046), the entire contents of which are hereby incorporated by reference.

The alignment device may also comprise a screen or grid containing elongate openings. The elongate openings of such a screen or grid may be provided in any desired pattern. For example, the abrasive article shown in FIG. 4 may be formed using an alignment device containing a plurality of concentric annular elongate slots that position the abrasive particles on the substrate. To apply abrasive particles using such a device, the alignment device is first positioned adjacent the substrate (the alignment device may either contact the substrate or be slightly spaced from the substrate). Abrasive particles are then arranged in the elongate slots by, for example, pouring the abrasive particles over the alignment device to at least partially fill the elongate slots. Next, excess abrasive particles are removed from the alignment device. Once the abrasive particles are bonded to the substrate, the alignment device is separated or removed from the substrate. In this manner, the oriented abrasive particles are left on the substrate in a pattern that matches the pattern provided by the alignment device.

It has been found that the size (i.e. volume) and weight (i.e. mass) of the abrasive particles can impact the degree of z-direction rotational orientation, and the position or placement of the abrasive particles 8 on the substrate 4. The impact of the size and weight of the abrasive particle can be particularly pronounced depending on the particular technique used to apply the abrasive particles 8 to the substrate 4. Accordingly, in certain embodiments, a portion of the abrasive particles 8 may have an average volume of at least 2, 3, 5 or 7 cubic millimeters, and may have an average weight of at least about 0.5, 1, 2 or 3 milligrams.

It will be recognized that the abrasive articles according to the present disclosure may be converted into, for example, an endless or continuous belts, discs (including perforated discs), sheets and/or pads. For belt applications, two free ends of a sheet-like abrasive article may be joined together using known methods to form a spliced belt. In addition, it will be recognized that the make coat may be provided as a layer across the entire first major surface of the abrasive article, it may be provided on only select regions of the first major surface, such as regions 16*a*, 16*b* and 16*c*, or the make coat may be applied directly to the abrasive particles prior to affixing the abrasive particles to the backing. In addition, the coating weight of the abrasive particles in the various embodiments described herein may range from at least about 1000, 1500 or 2000 grams/square meter ($g/m^2$), to no greater than about 4000, 4500 or 5000 $g/m^2$.

The abrasive articles described herein can be used for a variety of abrading applications including, for example, grinding, cutting and machining applications. In a particular end use application, the abrasive article is a coated abrasive belt used to grind metal, such as titanium or steel.

In order that the invention described herein can be more fully understood, the following examples are set forth. It should be understood that these examples are for illustrative purposes only, and are not to be construed as limiting this invention in any manner.

EXAMPLES

Objects and advantages of this disclosure are further illustrated by the following non-limiting examples, but the particular materials and amounts thereof recited in these examples, as well as other conditions and details, should not be construed to unduly limit this disclosure. Unless otherwise noted, all parts, percentages, ratios, etc. in the Examples and the rest of the specification are by weight.

Unless stated otherwise, all other reagents were obtained, or are available from fine chemical vendors such as Sigma-Aldrich Company, St. Louis, Mo., or may be synthesized by known methods.

Unit Abbreviations Used in the Examples:

° C.: degrees Centigrade
cm: centimeter
$g/m^2$: grams per square meter
mm: millimeter Abrasive Particles Used in the Examples:

TABLE 1

| ABBREVIATION | DESCRIPTION |
|---|---|
| AP1 | Shaped abrasive particles were prepared according to the disclosure of U.S. Pat. No. 8,142,531. The shaped abrasive particles were prepared by molding alumina sol gel in equilateral triangle-shaped polypropylene mold cavities of side length 0.20 inch (5.1 mm) and a mold depth of 0.05 inch (1.3 mm). After drying and firing, the resulting shaped abrasive particles were about 2.5 mm (side length) × 0.5 mm thick, with a draft angle approximately 98 degrees. |
| AP2 | Shaped abrasive particles were prepared according to the disclosure of U.S. Pat. No. 8,142,531. The shaped abrasive particles were prepared by molding alumina sol gel in equilateral triangle-shaped polypropylene mold cavities of side length 0.11 inch (2.794 mm) and a mold depth of 0.028 inch (0.711 mm). After drying and firing, the resulting shaped abrasive particles were about 1.4 mm (side length) × 0.35 mm thick, with a draft angle approximately 98 degrees, and would pass through a 30-mesh USA Standard Testing Sieve. |
| AP3 | Aluminum oxide conforming the FEPA (Federation of the European Producers of Abrasives) standard for P60 (obtained under trade designation "DURALUM" in grit size 60 from Washington Mills, Grafton, Massachusetts. |

Examples 1-3 and Comparatives A-C

Example 1

Untreated polyester cloth having a basis weight of 300-400 g/m$^2$, obtained under the trade designation "POWER-STRAIT" from Milliken & Company, Spartanburg, S.C., was pre-sized at the basis weight of 113 g/m$^2$ with a composition consisting of 75 parts epoxy resin (bisphenol A diglycidyl ether, obtained under trade designation "EPON 828" from Resolution Performance Products, Houston, Tex.), 10 parts of trimethylolpropane triacrylate (obtained under trade designation "SR351" from Cytec Industrial Inc., Woodland Park, N.J.), 8 parts of dicyandiamide curing agent (obtained under trade designation "DICYANEX 1400B" from Air Products and Chemicals, Allentown, Pa.), 5 parts of novolac resin (obtained under trade designation "RUTAPHEN 8656" from Momentive Specialty Chemicals Inc., Columbus, Ohio), 1 part of 2,2-dimethoxy-2-phenylacetophenone (obtained under trade designation "IRGACURE 651" photoinitiator from BASF Corporation, Florham Park, N.J.), and 0.75 part of 2-propylimidazole (obtained under trade designation "ACTIRON NXJ-60 LIQUID" from Synthron, Morganton, N.C.).

The cloth backing was coated with 209 g/m$^2$ of a phenolic make resin consisting of 52 parts of resole phenolic resin (obtained under trade designation "GP 8339 R-23155B" from Georgia Pacific Chemicals, Atlanta, Ga.), 45 parts of calcium metasilicate (obtained under trade designation "WOLLASTOCOAT" from NYCO Company, Willsboro, N.Y.), and 2.5 parts of water using a knife to fill the backing weave and remove excess resin.

Abrasive particles AP1 were applied to the make resin-coated backing by passing the abrasive particles through an alignment device comprising a plurality of elongate slots. The lateral spacing or gap between adjacent elongate slots was 1.3 mm. The coating weight of AP1 was 1172 g/m$^2$ with a variation of ±42 g/m$^2$ over the sample. The abrasive coated backing was placed in an oven at 90° C. for 1.5 hours to partially cure the make resin. A size resin consisting of 45.76 parts of resole phenolic resin (obtained under trade designation "GP 8339 R-23155B" from Georgia Pacific Chemicals), 4.24 parts of water, 24.13 parts of cryolite (Solvay Fluorides, LLC, Houston, Tex.), 24.13 parts calcium metasilicate (obtained under trade designation "WOLLASTOCOAT" from NYCO Company, Willsboro, N.Y.) and 1.75 parts red iron oxide was applied to each strip of backing material at a basis weight of 712 g/m$^2$, and the coated strip was placed in an oven at 90° C. for 1 hour, followed by 8 hours at 102° C. After cure, the strip of coated abrasive was converted into a belt as is known in the art.

Comparative Example A

The procedure generally described in Example 1 was repeated, with the exception that the abrasive particles AP1 were applied to the make resin-coated backing material via conventional drop coating.

Example 2

The procedure generally described in Example 1 was repeated, with the exception that AP1 was replaced with AP2, the coating weight of AP2 was 607 g/m$^2$ with a variation of ±21 g/m$^2$ over the sample, and the lateral spacing along x-axis between adjacent elongate slots on the alignment device was 0.864 mm.

Comparative Example B

The procedure generally described in Example 2 was repeated, with the exception that the abrasive particles AP2 were applied to the make resin-coated backing material via electrostatic coating at a coating weight of 607 g/m$^2$.

Example 3

Untreated polyester cloth having a basis weight of 300-400 g/m$^2$, obtained under the trade designation "POWER-STRAIT", was coated with 113 g/m$^2$ of pre-size resin with the same composition as described in Example 1. The cloth backing was then coated with 209 g/m$^2$ of a phenolic make resin with the same composition as that in Example 1.

Abrasive particles AP2 were applied to the make resin-coated backing by passing the abrasive particles through an alignment device comprising a plurality of elongate slots. The lateral spacing or gap between adjacent elongate slots was 0.864 mm. The coating weight of AP2 was 334.8 g/m$^2$ with a variation of ±28.8 g/m$^2$ over the sample. Then the abrasive particles AP3 were applied to the AP2-coated backing material via electrostatic coating at a coating weight of 150.6 g/m$^2$ with a variation of ±13.0 g/m$^2$ over the sample. The abrasive coated backing was placed in an oven at 90° C. for 1.5 hours to partially cure the make resin. A size resin was applied to each strip of backing material at a basis weight of 502 g/m$^2$. A size resin consists of 45.76 parts of resole phenolic resin (obtained as GP 8339 R-23155B from Georgia Pacific Chemicals), 4.24 parts of water, 48.26 parts of cryolite (Solvay Fluorides, LLC, Houston, Tex.), and 1.75 parts red iron oxide. The coated strip was then placed in an oven at 90° C. for 1 hour, followed by 8 hours at 102° C. After cure, the strip of coated abrasive was converted into a belt as is known in the art.

Comparative Example C

The procedure of preparing the pre-size coated, make resin coated cloth backing generally described in Example 3 was repeated. An abrasive particle mixture was prepared by thoroughly blending 69% of abrasive particles AP2 and 31% of abrasive particles AP3. The abrasive particle mixture was applied to the make resin-coated backing material via electrostatic coating at a coating weight of 485.5 g/m$^2$ with a variation of ±41.8 g/m$^2$ over the sample. The abrasive coated backing was then partially cured, coated with size resin, cured, and converted into a belt with the procedure as described in Example 3.

Performance Test

Grinding Test Procedure A

Grinding Test Procedure A was used to evaluate the coated abrasive belt performance during volumetric grinding by measuring the grinding force normal to the abraded surface. Test belts were of the dimension 10.16 cm×203.2 cm. The contact wheel was 46.00 cm in diameter, 90 durometer Shore A hardness and had a 1:1 land to groove serration ratio at a 45 degree angle. Test belts were driven to a speed of 584 meters per minute. The titanium workpiece surface to be abraded measured 1.27 cm by 35.6 cm. For each test, a workpiece was mounted on the reciprocating table of the grinding machine with the longer axis of the workpiece parallel to the direction of the table motion. The mounted coated abrasive belt was positioned to provide a 0.40 mm interference with the surface of the workpiece. The table was traversed at a speed of 6.1 meters per minute in a direction parallel to the movement of the abrasive article at the grinding interface. At the end of each table traverse, the 0.40 mm interference was re-established. If one workpiece became worn down to a point where it was no longer in contact with the abrasive article, a new workpiece was mounted on the reciprocating table. For each grinding test, 350 to 500 milliliters per minute of water with a biocide as a coolant was applied to the abraded surface of the work piece as it moved away from the grinding interface. When the table was traversed in the opposite direction, a stream of compressed air was used to remove any residual water from the surface of the work piece prior to it contacting the coated abrasive. The force normal to the grinding interface was monitored via a strain gauge on the reciprocating table on which the workpiece was mounted. The end point of the test was 200 cycles or when the normal force reached 800 Newtons (82 kilograms-force). The test results for Example 1 and Comparative A are shown in Table 2.

Grinding Test Procedure B

Grinding Test Procedure B was used to evaluate the efficacy of inventive and comparative abrasive belts. Test belts were of the dimension 10.16 cm×91.44 cm. The workpiece was a 304 stainless steel bar that was presented to the abrasive belt along its 1.9 cm×1.9 cm end. A 20.3 cm diameter, 70 durometer Shore A, serrated (1:1 land to groove ratio) rubber contact wheel was used. The belt was run at 5500 surface feet per minute (28 meters per second). The workpiece was urged against the center part of the belt at a blend of normal forces from 10 to 15 pounds (4.53 to 6.8 kilograms). The test consisted of measuring the weight loss of the workpiece after 15 seconds of grinding (1 cycle). The workpiece was then cooled and tested again. The test was concluded after 30 test cycles. The total cut (the cumulative weight loss of the workpiece) in grams was recorded after each cycle. The test results for Example 2 and Comparative B are shown in Table 3.

Grinding Test Procedure C

Test belts were of the dimension 10.16 cm×91.44 cm. The workpiece was a 304 stainless steel bar that was presented to the abrasive belt along its 1.9 cm×1.9 cm end. A 20.3 cm diameter, 50 durometer Shore A, smooth faced rubber contact wheel was used. The belt was run at 5500 surface feet per minute (28 meters per second). The workpiece was urged against the center part of the belt at a normal forces from 5 pounds (kilograms). The test consisted of measuring the weight loss of the workpiece after 15 seconds of grinding (1 cycle). The workpiece was then cooled and tested again. The test was concluded after 30 test cycles. The total cut (the cumulative weight loss of the workpiece) in grams was recorded after each cycle. The test results for Example 3 and Comparative C are shown in Table 4.

TABLE 2

Normal Force in Newtons Using Grinding Test Procedure A

| Cycle (direction) | Example 1 | Comparative A |
|---|---|---|
| 1 (downcut) | 22.1 | 39.0 |
| 2 (upcut) | 25.6 | 16.8 |
| 19 (downcut) | 147.8 | 148.3 |
| 20 (upcut) | 154.3 | 148.0 |
| 39 (downcut) | 167.6 | 277.0 |
| 40 (upcut) | 163.2 | 275.4 |
| 59 (downcut) | 206.7 | 361.0 |
| 60 (upcut) | 220.9 | 370.3 |
| 79 (downcut) | 219.2 | 441.0 |
| 80 (upcut) | 219.6 | 446.7 |
| 99 (downcut) | 242.0 | 506.3 |
| 100 (upcut) | 251.3 | 508.0 |
| 119 (downcut) | 237.1 | 572.6 |
| 120 (upcut) | 247.5 | 569.2 |
| 139 (downcut) | 265.6 | 618.8 |
| 140 (upcut) | 271.1 | 614.8 |
| 159 (downcut) | 260.6 | 634.3 |
| 160 (upcut) | 274.4 | 661.2 |
| 179 (downcut) | 296.9 | 704.2 |
| 180 (upcut) | 294.0 | 691.9 |
| 199 (downcut) | 291.1 | 719.8 |
| 200 (upcut) | 315.7 | 720.8 |

TABLE 3

Cumulative Cut in Grams Using Grinding Test Procedure B

| Cycle | Example 2 | Comparative B |
|---|---|---|
| 1 | 33.49 | 30.25 |
| 2 | 65.44 | 57.48 |
| 3 | 97.15 | 83.28 |
| 4 | 127.92 | 108.04 |
| 5 | 157.44 | 132.67 |
| 6 | 185.72 | 156.27 |

TABLE 3-continued

| Cumulative Cut in Grams Using Grinding Test Procedure B | | |
|---|---|---|
| Cycle | Example 2 | Comparative B |
| 7 | 214.15 | 179.21 |
| 8 | 241.79 | 202.35 |
| 9 | 268.52 | 224.81 |
| 10 | 294.79 | 246.36 |
| 11 | 320.64 | 267.81 |
| 12 | 345.79 | 289.10 |
| 13 | 370.48 | 309.76 |
| 14 | 394.82 | 329.78 |
| 15 | 418.63 | 349.37 |
| 16 | 441.77 | 369.16 |
| 17 | 464.51 | 388.36 |
| 18 | 486.51 | 407.16 |
| 19 | 508.07 | 425.63 |
| 20 | 528.92 | 443.38 |
| 21 | 549.06 | 460.83 |
| 22 | 568.62 | 477.60 |
| 23 | 588.00 | 494.14 |
| 24 | 607.23 | 510.60 |
| 25 | 626.30 | 526.66 |
| 26 | 644.34 | 542.26 |
| 27 | 661.93 | 557.45 |
| 28 | 679.38 | 572.05 |
| 29 | 696.50 | 586.58 |
| 30 | 713.50 | 601.18 |

TABLE 4

| Cumulative Cut in Grams Using Grinding Test Procedure C | | | | | | |
|---|---|---|---|---|---|---|
| | Example 3 | | | Comparative C | | |
| Cycle | Test 1 | Test 2 | Test 3 | Test 1 | Test 2 | Test 3 |
| 1 | 16.34 | 14.25 | 16.60 | 11.90 | 12.49 | 14.68 |
| 2 | 32.81 | 27.10 | 33.66 | 22.00 | 22.75 | 27.12 |
| 3 | 49.38 | 39.45 | 50.50 | 30.69 | 30.93 | 38.37 |
| 4 | 65.46 | 51.40 | 67.28 | 37.76 | 37.62 | 47.93 |
| 5 | 80.93 | 63.13 | 83.31 | 43.87 | 43.45 | 56.09 |
| 6 | 95.49 | 74.25 | 98.17 | 49.10 | 48.40 | 62.85 |
| 7 | 109.73 | 85.19 | 112.35 | 53.77 | 52.66 | 68.39 |
| 8 | 123.17 | 95.54 | 125.59 | 57.76 | 56.49 | 73.71 |
| 9 | 135.98 | 105.70 | 138.03 | 61.22 | 60.15 | 78.30 |
| 10 | 147.59 | 115.50 | 149.97 | 64.53 | 63.19 | 82.34 |
| 11 | 157.86 | 124.83 | 160.57 | 67.39 | 65.99 | 85.79 |
| 12 | 167.18 | 133.89 | 170.49 | 69.98 | 68.75 | 88.89 |
| 13 | 175.67 | 142.53 | 179.74 | 72.33 | 71.23 | 91.90 |
| 14 | 183.15 | 151.05 | 188.28 | 74.63 | 73.56 | 94.77 |
| 15 | 190.11 | 159.35 | 196.23 | 76.73 | 75.76 | 97.44 |
| 16 | 196.63 | 167.40 | 203.21 | 78.84 | 77.86 | 100.03 |
| 17 | 202.43 | 175.11 | 209.65 | 80.96 | 79.96 | 102.44 |
| 18 | 207.48 | 182.54 | 215.25 | 83.05 | 81.95 | 104.97 |
| 19 | 211.90 | 189.63 | 220351 | 85.26 | 83.99 | 107.47 |
| 20 | 215.96 | 196.55 | 225.48 | 87.45 | 85.94 | 109.80 |
| 21 | 219.91 | 203.26 | 230.13 | 89.75 | 87.88 | 111.97 |
| 22 | 223.45 | 209.80 | 234.65 | 91.91 | 89.85 | 114.18 |
| 23 | 226.72 | 215.81 | 238.72 | 93.94 | 91.68 | 116.40 |
| 24 | 229.79 | 221.75 | 242.43 | 96.03 | 93.50 | 118.44 |
| 25 | 232.78 | 227.64 | 245.88 | 98.06 | 95.32 | 120.34 |
| 26 | 235.57 | 233.20 | 249.09 | 100.09 | 97.14 | 122.16 |
| 27 | 238.03 | 238.87 | 252.03 | 102.09 | 98.94 | 123.22 |
| 28 | 240.32 | 244.32 | 254.89 | 104.16 | 100.73 | 126.15 |
| 29 | 242.52 | 249.54 | 257.59 | 106.16 | 102.56 | 128.05 |
| 30 | 244.69 | 254.50 | 260.29 | 108.11 | 104.38 | 129.91 |

Example 4 and Comparative D

Example 4

A make resin was prepared by mixing 22.3 parts epoxy resin (obtained under trade designation "HELOXY 48" from Hexion Specialty Chemicals, Houston, Tex.), 6.2 parts trimethylolpropane triacrylate monomer (obtained under trade designation "TMPTA" from UCB Radcure, Savannah, Ga.) followed by adding 1.2 parts photoinitiator (obtained under trade designation "IRGACURE 651" from Ciba Specialty Chemicals, Hawthorne, N.Y.) with heating until the photoinitiator was dissolved. 51 parts resole phenolic resin (based-catalyzed condensate from 1.5:1 to 2.1:1 molar ratio of phenol:formaldehyde), 73 parts calcium carbonate (obtained under trade designation "HUBERCARB" from Huber Engineered Materials, Quincy, Ill.) and 8 parts water were added with mixing. 4.5 grams of this mixture was applied with a brush to a 7-inch (17.8 cm) diameter×0.83 mm thick circular vulcanized fiber web (obtained under trade designation "DYNOS VULCANIZED FIBRE" from DYNOS GmbH, Troisdorf, Germany) having a 0.875 inch (2.22 cm) center hole. The coated disc was then passed under a UV lamp at 20 feet per minute (6.1 meters per minute) to gel the coating.

The make resin-coated fiber disc was placed with make resin side up on a flat surface. Abrasive particles AP2 were applied to the make resin-coated backing by passing the abrasive particles through an alignment device comprising a plurality of concentric annular elongate slots. The spacing or gap between adjacent slots was 0.864 mm. The weight of the shaped grain mineral transferred to the outer 3.8 cm circumference of each disc was 7.33 grams. The make resin was then thermally cured (90° C. for 90 minutes followed by 105° C. for 3 hours).

Comparative Example D

The procedure generally described in Example 4 was repeated, with the exception that the abrasive particles AP2 were applied to the make resin-coated backing material via electrostatic coating at a coating weight of 16.6 grams per disc.

Sample Analysis and Method of Determining Z-Axis Rotational Angle Distribution

For Examples 1, 2 and Comparative Examples A, B (abrasive article constructions having a linear particle orientation), a digital micrograph was taken of a representative section of abrasive particles on the coated cloth backing with the down web direction roughly horizontal. The sample contained several hundred abrasive particles. The digital image was copied into a Microsoft PowerPoint presentation. The total number of abrasive particles in the digital image was then counted, and the total number of abrasive particles in the digital image that were upright was counted. The percentage of upright abrasive particles in the digital image was then calculated and is reported in the first column of Table 5. To determine the z-axis rotational orientation of the abrasive particles, abrasive particles in the sample that were upright and whose bases were visible end-to-end were visually identified. Lines were drawn parallel to each abrasive particle base and the lengths of the x- and y-axis projections of each abrasive particle were measured by the PowerPoint program. The x-axis projection was measured left to right and was always positive. The y-axis projection was measured similarly and could be positive (upward slope left to right) or negative (downward slope left to right). The projection pairs were transferred to a Microsoft Excel file. The rotational orientation of each abrasive particle was calculated between the range of +90 degrees and −90 degrees using the formula: ATAN (y-axis projection/x-axis projection)/(π/2)*90. The angle data to the nearest whole degree was sorted in the Excel file from smallest to largest and the number of occurrences of each angle was recorded.

The actual down web angle of the backing relative to the picture coordinates was determined by measuring the angle of the weave of the cloth backing using the same method as measuring the z-axis direction rotational orientation. This was used as a reference for the expected center of the angle distribution. The fraction of x-axis rotational orientation angle measurements occurring between +45 and −45 degrees of the backing reference angle was calculated and is listed in Table 2. For a random distribution, the value would be expected to be 50% as this is half of the available angles. Similar calculations were performed to obtain the distributions of narrower angular ranges (i.e. +30 to −30, +20 to −20, +10 to −10 or +5 to −5 degrees of the backing reference angle). These results are also reported in Table 5.

corrected by adding 180 degrees (for angles less than −90 degrees) or subtracting 180 degrees (for angles greater than 90 degrees). The angle data to the nearest whole degree was sorted in the Excel file from smallest to largest and the number of occurrences of each angle was recorded. The fraction of x-axis rotational orientation angle measurements occurring between +45 and −45 degrees of the disc tangent was calculated and is listed in Table 5. For a random distribution, the value would be expected to be 50% as this is half of the available angles. Similar calculations were performed to obtain the distributions of narrower angular ranges (i.e. +30 to −30, +20 to −20, +10 to −10 or +5 to −5 degrees of the backing reference angle). Those results are also reported in Table 5.

TABLE 5

| | Fraction of | Fraction of Particles within the Specified Angle Range | | | | |
|---|---|---|---|---|---|---|
| | Upright Particles | +45 to −45 Degrees | +30 to −30 Degrees | +20 to −20 Degrees | +10 to −10 Degrees | +5 to −5 Degrees |
| Random Distribution (Theoretical Values) | — | 50% | 33% | 22% | 11% | 6% |
| Example 1 | 88% | 91% | 84% | 72% | 42% | 28% |
| Comparative A | 25% | 50% | 33% | 23% | 13% | 7% |
| Example 2 | 85% | 93% | 90% | 78% | 49% | 31% |
| Comparative B | 77% | 52% | 36% | 27% | 14% | 7% |
| Example 4 | 94% | 97% | 91% | 82% | 56% | 33% |
| Comparative D | 91% | 46% | 32% | 20% | 12% | 8% |

For Example 4 and Comparative Example D (fibre disc constructions having a radial particle orientation), a digital micrograph was taken of a representative section of abrasive particles on the coated vulcanized fibre backing which included the center hole of the disc backing. The sample contained several hundred abrasive particles. The digital image was copied into a Microsoft PowerPoint presentation. The total number of abrasive particles in the digital image was then counted, and the total number of abrasive particles in the digital image that were upright was counted. The percentage of upright abrasive particles in the digital image was then calculated and is reported in the first column of Table 5. To determine the z-axis rotational orientation of the abrasive particles, abrasive particles in the sample that were upright and whose bases were visible end-to-end were visually identified. Lines were drawn parallel to each abrasive particle base and the lengths of the x- and y-axis projections of each abrasive particle were measured by the PowerPoint program. The x-axis projection was measured left to right and was always positive. The y-axis projection was measured similarly and could be positive (upward slope left to right) or negative (downward slope left to right). Similarly, the x- and y-axis projections of a line connecting the center of each particle base and the rotational center point of the disc was also measured for each particle. The two sets of projection pairs were transferred to a Microsoft Excel file. The rotational orientation angle of each abrasive particle and the angle of the particle with respect to the disc center was calculated between the range of +90 degrees and −90 degrees using the formula: ATAN (y-axis projection/x-axis projection)/(π/2)*90. The two angles were added to produce the angle of deviation of each grain from a line tangent to a circle passing through the grain base center and having a center coincident with the disc rotational center point. Angles greater than 90 and less than −90 degrees were Persons of ordinary skill in the art may appreciate that various changes and modifications may be made to the invention described above without deviating from the inventive concept. Thus, the scope of the present invention should not be limited to the structures described in this application, but only by the structures described by the language of the claims and the equivalents of those structures.

What is claimed is:

1. An abrasive article having a y-axis corresponding to a longitudinal direction of the abrasive article, an x-axis transverse to the y-axis and corresponding to a lateral direction of the abrasive article which is perpendicular to the y-axis, and a z-axis orthogonal to the y-axis and x-axis such that the x-axis and y-axis define a plane that generally corresponds to a first major surface of the abrasive article and the z-axis extends outwardly from the plane in a direction away from the first major surface, the abrasive article comprising a plurality of elongate abrasive particles having an elongate edge positioned on the first major surface, such that each of the plurality of elongate abrasive particles is positioned upright from the first major surface and comprises a rotational orientation of its elongate edge on the first major surface about the z-axis, wherein the rotational orientation of at least a portion of the abrasive particles about the z-axis varies randomly within a defined range such that the rotational orientation of at least 55 percent of the abrasive particles is within +/−45 degrees of an average rotational orientation of the abrasive particles, and wherein the spacing of the abrasive particles varies randomly along the y-axis.

2. An abrasive article as defined in claim 1, wherein the spacing of the abrasive particles in the x-axis direction is random.

3. An abrasive article as defined in claim 2, wherein the spacing of the abrasive particles is more uniform in the x-axis direction than the y-axis direction.

4. An abrasive article as defined in claim 1, wherein the spacing of the abrasive particles in the x-axis direction varies within a defined range.

5. An abrasive article as defined in claim 4, wherein each of the abrasive particles has a length, a width, and a thickness, wherein the length is the maximum caliper dimension of the particle, the width is the maximum caliper dimension of the particle perpendicular to the length, and the thickness is the caliper dimension of the particle perpendicular to the length and the width, wherein the abrasive particles are arranged in rows such that each abrasive particle in a row has a location along the x-axis, and further wherein an average deviation of the location of an abrasive particle along the direction of the x-axis within a row varies randomly by no more than plus or minus (+/−) 4 times the thickness of the abrasive particle.

6. An abrasive article as defined in claim 1, wherein at least a portion of the abrasive particles are arranged in a row having a longitudinal axis, each abrasive particle has a longitudinal axis, and the longitudinal axis of at least a portion of the abrasive particles is within a defined range relative to the longitudinal axis of the row.

7. An abrasive article as defined in claim 6, wherein the longitudinal axis of the row is generally parallel to the y-axis of the abrasive article.

8. An abrasive article as defined in claim 6, wherein the longitudinal axis of the row is offset at an angle from the y-axis of the abrasive article.

9. An abrasive article as defined in claim 1, wherein the abrasive particles are provided in a generally arcuate path and the y-axis is tangent to the arcuate path.

10. An abrasive article as defined in claim 1, wherein at least a portion of the abrasive particles have a length, width, and a thickness, wherein the length is the maximum caliper dimension of the particle, the width is the maximum caliper dimension of the particle perpendicular to the length, and the thickness is the caliper dimension of the particle perpendicular to the length and the width, and further wherein width and length are greater than the thickness.

11. An abrasive article as defined in claim 1, wherein at least a portion of the abrasive particles have a generally plate-like shape.

12. An abrasive article as defined in claim 1, wherein at least a portion of the abrasive particles comprise crushed abrasive particles, shaped abrasive particles, and combinations thereof.

13. An abrasive article as defined in claim 1, wherein the abrasive particles comprise an agglomerate having a plate-like shape.

14. An abrasive article as defined in claim 1, wherein the abrasive article includes a mixture of abrasive particles comprising a first portion having a generally uniform size and shape, and a second portion having a generally uniform size and a non-uniform shape.

15. An abrasive article as defined in claim 1, wherein 80-90 percent of the abrasive particles are inclined at an angle of at least 45 degrees from a plane defined by the x and y axes.

16. A coated abrasive article comprising:

a) a backing having opposed first and second major surfaces, a longitudinal axis along the first major surface, a transverse axis along the first major surface perpendicular to the longitudinal axis, and a z-axis perpendicular to the longitudinal axis and the transverse axis;

b) a make coat on at least a portion of the first major surfaces; and c) a plurality of abrasive particles secured to the first major surface of the backing via the make coat, wherein each abrasive particle includes a y-direction axis extending along the first major surface, and a z-direction axis orthogonal to the longitudinal axis and the transverse axis of the backing, each abrasive particle having a rotational orientation about its z-direction axis of its y-direction axis relative to the longitudinal axis;

wherein the rotational orientation of a majority of the abrasive particles about the z-axis varies randomly within a defined range such that the rotational orientation of at least 55 percent of the abrasive particles is within +/−45 degrees of an average rotational orientation of the abrasive particles, and further wherein the spacing of the abrasive particles along the longitudinal axis of the abrasive article varies randomly.

17. A circular abrasive disc comprising:

a) a backing having opposed first and second major surfaces, an annular path along the first major surface, a first axis that is tangent to the annular path at a location of abrasive particles, a radial axis that is orthogonal to the tangent axis such that the first axis and the radial axis are each located along the first major surface, and a z-axis orthogonal to the first major surfaces;

b) a make coat on the first major surfaces; and c) a plurality of abrasive particles secured to the backing via the make coat, wherein the rotational orientation of a majority of the abrasive particles about the z-axis varies randomly within a defined range such that the rotational orientation of at least 55 percent of the abrasive particles is within +/−45 degrees of an average rotational orientation of the abrasive particles with respect to the first axis, and further wherein the spacing of the abrasive particles along the annular path varies randomly.

18. A method of grinding metal, comprising the steps of providing an abrasive article as defined in claim 16 in the form of a continuous belt, and bringing the continuous belt into contact with the metal.

* * * * *